US010186798B2

(12) United States Patent
Kleeberger et al.

(10) Patent No.: US 10,186,798 B2
(45) Date of Patent: Jan. 22, 2019

(54) APPARATUS AND METHOD FOR GANGING CABLE CONNECTORS TOGETHER FOR PURPOSES OF PLUGGING AND UNPLUGGING CONNECTORS

(71) Applicant: AFL IG LLC, Kent, WA (US)

(72) Inventors: Terry Kleeberger, Tacoma, WA (US); Paul Robinson, Bainbridge Island, WA (US); Artur Bureacov, Federal Way, WA (US)

(73) Assignee: AFL IG LLC, Kent, WA (US)

( * ) Notice: Subject to any disclaimer, the term of this patent is extended or adjusted under 35 U.S.C. 154(b) by 114 days.

(21) Appl. No.: 15/123,638

(22) PCT Filed: Mar. 4, 2015

(86) PCT No.: PCT/US2015/018840
§ 371 (c)(1),
(2) Date: Sep. 3, 2016

(87) PCT Pub. No.: WO2015/134683
PCT Pub. Date: Sep. 11, 2015

(65) Prior Publication Data

US 2017/0077641 A1 Mar. 16, 2017

Related U.S. Application Data

(60) Provisional application No. 61/947,927, filed on Mar. 4, 2014, provisional application No. 61/981,786, filed
(Continued)

(51) Int. Cl.
*H01R 13/518* (2006.01)
*H01R 13/627* (2006.01)
(Continued)

(52) U.S. Cl.
CPC ..... *H01R 13/518* (2013.01); *H01R 13/6272* (2013.01); *H01R 24/64* (2013.01); *H01R 43/26* (2013.01)

(58) Field of Classification Search
CPC ..... H01R 13/518; H01R 13/6272; H01R 13/514; H01R 13/629; H01R 24/64; H01R 43/26
(Continued)

(56) References Cited

U.S. PATENT DOCUMENTS 8,167,638 B2 * 5/2012 Wojcik ..... H01R 13/506 439/352
8,348,686 B1 1/2013 Huang
(Continued)

FOREIGN PATENT DOCUMENTS

| | | |
|---|---|---|
| EP | 1267450 | 12/2002 |
| GB | 2486258 | 6/2012 |
| WO | 2004097989 | 11/2004 |

*Primary Examiner* — Vanessa Girardi
(74) *Attorney, Agent, or Firm* — DWC Law Firm, P.S.; David Chen

(57) ABSTRACT

Methods and apparatus are provided for use in connecting and disconnecting cable connectors to and from communication ports. In some embodiments, a connector assembly has a ganging member, a plunger member, and a key. The ganging member can retain a plurality of cable connectors, and be used to simultaneously connect/disconnect groups of cable connectors. The plunger member can have a plurality of elongated plungers usable to simultaneously unlock or lock the cable connectors.

19 Claims, 12 Drawing Sheets

Related U.S. Application Data on Apr. 19, 2014, provisional application No. 62/104, 081, filed on Jan. 16, 2015.

(51) Int. Cl.
*H01R 24/64* (2011.01)
*H01R 43/26* (2006.01)

(58) Field of Classification Search
USPC ..... 439/540.1, 701, 553
See application file for complete search history.

(56) References Cited

U.S. PATENT DOCUMENTS

| | | | | |
|---|---|---|---|---|
| 8,529,284 | B1 | 9/2013 | Smith | |
| 9,069,149 | B2 * | 6/2015 | Yu | G02B 6/3898 |
| 2012/0030937 | A1 | 2/2012 | Wang | |

* cited by examiner

APPARATUS AND METHOD FOR GANGING CABLE CONNECTORS TOGETHER FOR PURPOSES OF PLUGGING AND UNPLUGGING CONNECTORS

CROSS REFERENCE TO RELATED APPLICATION(S)

This application is the US national phase entry of International Patent Application No. PCT/US2015/018840, filed Mar. 4, 2015, which claims priority to U.S. Provisional Patent Application No. 61/947,927, filed Mar. 4, 2014, U.S. Provisional Patent Application No. 61/981,786 filed Apr. 19, 2014, and U.S. Provisional Patent Application No. 62/104,081 filed Jan. 16, 2015, all of which are incorporated herein by reference in their entireties.

BACKGROUND

1. Technical Field

This application relates to tools for connecting and extracting connectors for cables, to and from corresponding mating connectors, and in particular, to tools for connecting and extracting connectors with integrated locking mechanisms.

2. Description of Related Art

Modular connectors, or other types of connectors, are typically used in connecting electrical (e.g., copper) cables or fiber-optic cables in communications systems or networks. For example, a common modular connector for computer networking is referred to as RJ45.

A receiving port or socket for use with modular connectors can comprise contacts corresponding with those on a connector plug. The connector plug can snap fit within the socket. A locking tab mechanism is commonly employed, such that when the tab is depressed, the modular connector plug is released from a push-fit connection with the receiving port or socket.

Some grouping tools, or ganging devices, are available on the market for use in connecting multiple connectors to sockets simultaneously, which is highly desirable in to facilitate quick assembly of network structures. However, typically, the available tools do not allow an individual cable/connector to be removed from the connection ports after they are installed in ganged configuration as a group. Also, operation of these typical grouping devices can be cumbersome.

BRIEF SUMMARY

This Brief Summary is provided to introduce a selection of concepts in a simplified form that are further described below in the Detailed Description. This Brief Summary is not intended to identify key features or essential features of the claimed subject matter, nor is it intended to be used as an aid in determining the scope of the claimed subject matter.

The various embodiments of assemblies, apparatus, systems, and methods presented by this disclosure can provide unique and convenient manners for coupling cable connectors of various kinds to housings, and housings to ganging members for use in simultaneously connecting or disconnecting a plurality of connectors to or from receiving ports. Moreover, various embodiments of this disclosure provide a unique and convenient manner of using a plunger member to mate with the ganging member to simultaneously lock a plurality of the housings to the ganging member, as well as retain locking tabs of the connectors in locked positions (for insertion or for security). Moreover, in various embodiments, a user can unlock the plunger member from the ganging device to free up the locking tabs of the cable connectors to be depressible via a housing release button. The user can easily remove the ganging device from the connected cable connectors, to access the individuals housings, or can mate the plunger member with the ganging device in a reverse orientation, or second orientation, to simultaneously place all of the locking tabs of the connectors in released positions, so that all of the connectors attached to the ganging member can be pulled away from receiving ports simultaneously.

DETAILED DESCRIPTION

In the present description, certain specific details are set forth in order to provide a thorough understanding of various embodiments of the disclosure. However, upon reviewing this disclosure one skilled in the art will understand that the various embodiments disclosed herein may be practiced without many of these details. In other instances, some well-known structures and materials associated with cables (e.g., electric or fiber-optic), cable connectors (e.g., RJ-45, RJ-11, or other connectors including various fiber optic cable connectors), or the devices to which they connect, have not been described in detail to avoid unnecessarily obscuring the descriptions of the embodiments of the disclosure.

In the present disclosure, to the extent the terms "about" and "approximately" are used, they mean ±20% of the indicated range, value, or structure, unless otherwise indicated. In the present description, the terms "a" and "an" as used herein refer to "one or more" of the enumerated components. The use of the alternative (e.g., "or") should be understood to mean either one, both, or any combination thereof of the alternatives. As used herein, the terms "include" and "comprise" are used synonymously, which terms and variants thereof are intended to be construed as non-limiting. The definitions in this paragraph are intended to apply throughout this disclosure unless otherwise expressly stated.

Various embodiments in this disclosure are described in the context of use with electric (e.g., copper) wire cables and RJ45 connectors. However, as will be understood by those skilled in the art after reviewing this disclosure, various other types of cables (fiber-optic cables) and associated connectors may be suitable for use with the apparatus, systems and methods disclosed herein, which may be modified in the spirit of this disclosure to fit various other types of connectors.

Figure 1:
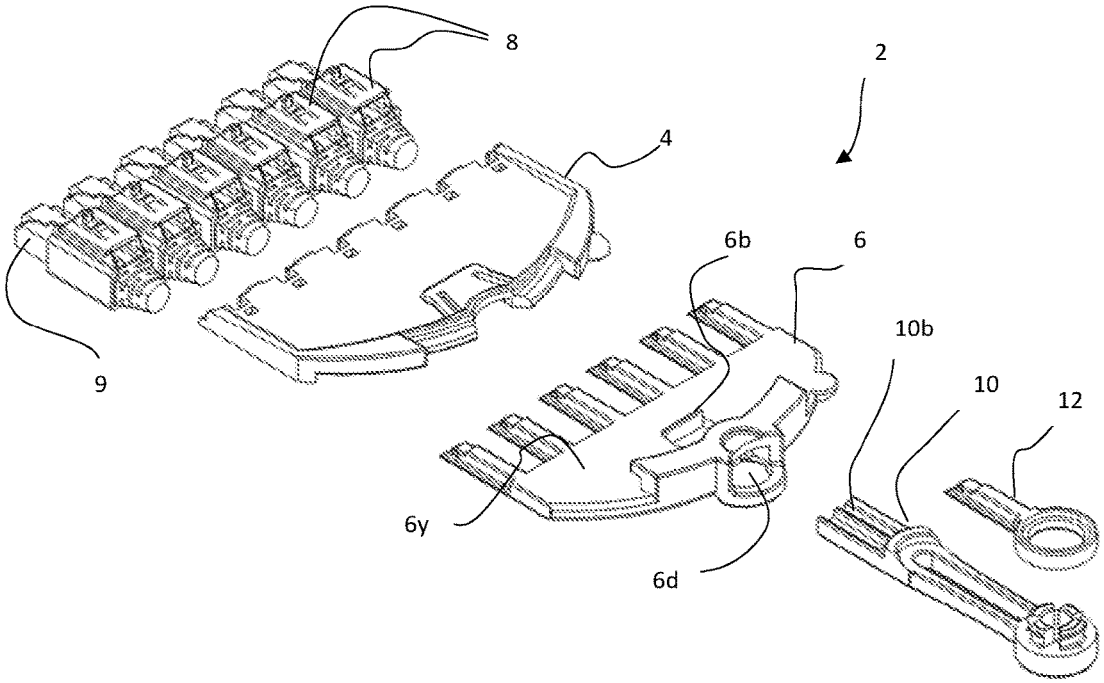
FIG. 1 is a perspective view of multiple components for a connector assembly for some embodiments of the present disclosure.

As shown FIG. 1, in some embodiments, a connector assembly 2, is provided, which can include a plunger member 6, ganging device 4, one or more connector housings 8 (each retaining a connector 9, connected to a communications cable), plunger key 10, and a housing key 12. The components of the connector assembly 2 can be used cooperatively; however, not all components are necessary in all embodiments, to achieve one or more of the functions disclosed herein, as described further below and as will be immediately appreciated by those skilled in the art after reviewing this disclosure.

Figure 2:
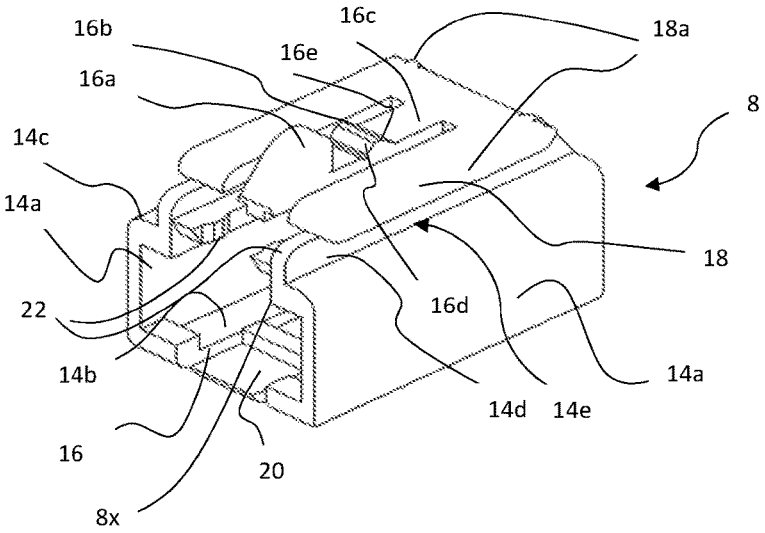
FIG. 2 is a perspective view of a housing for a connector assembly for some embodiments of the present disclosure.

Referring to FIG. 2, in some embodiments, one or more connector housings 8 can comprise a pair of spaced apart parallel upright sidewalls 14*a*, horizontal bottom wall members 14*b* extending inwardly from a bottom portion of each of the sidewalls 14*a*, and horizontal upper wall members 14*c* extending inwardly from an upper portion of each of the sidewalls 14*a*, the walls 14*a*, 14*b*, and 14*c*, collectively defining a channel 8*x* within which a connector 9, or portion thereof (as described further below) can be retained.

Furthermore, an upright riser wall 14*d* can extend upwardly from a top of each of the horizontal upper wall members 14*c*, and a horizontal top retaining wall 18 can be formed, or attached, top edge portions of the upright risers 14*d*, with lateral edges of the top retaining wall 18 overhanging the upright risers 14*d* as they extend out laterally to overlap the upper wall members 14*c*. Still referring to FIG. 2, it can be seen that the overhanging portions of the top retaining wall 18, the upright risers 14*d*, and horizontal upper wall members 14*c* can together define a longitudinally extending track channel 14*e*, that recesses laterally inward toward a laterally center portion of the housing 8. A track channel 14*e* can be provided on each side of the housing 8, and can slidably engage side portions of tracks 40 (See, e.g., FIG. 3) of the ganging device 4 to retain the connector housing 8 to the tracks 40, as described further below.

Figure 4:
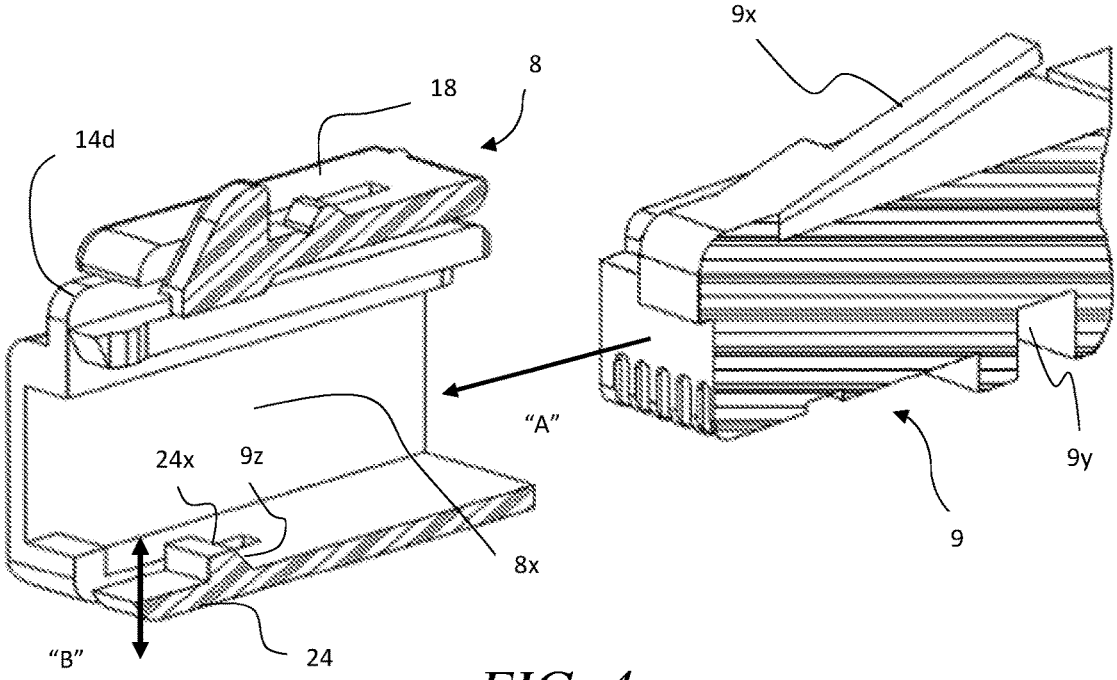
FIG. 4 is a partial cross sectional perspective view of the housing of FIG. 2, and a connector, for some embodiments of the present disclosure.
Figure 5:
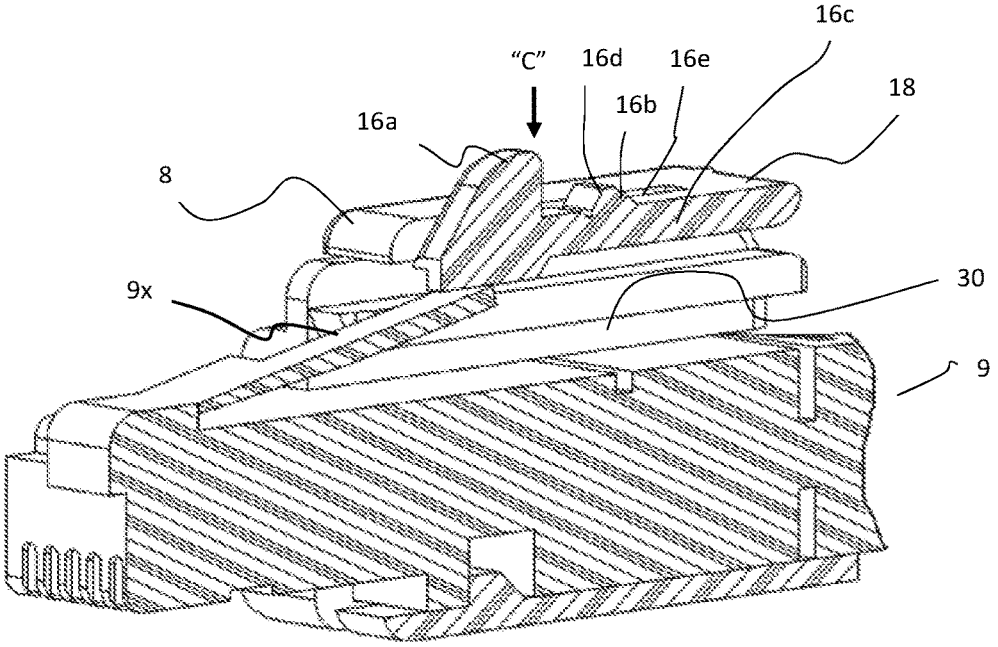
FIG. 5 is a partial cross sectional perspective view showing the housing and connector of FIG. 4, with the connector attached to the housing.

Referring to FIGS. 4 & 5, in some embodiments, a connector 9 (e.g., a common modular connector for computer networking, such as, for example, an RJ45 connector), can be longitudinally inserted through the channel 8*x* of a connector housing 8 to couple the connector 9 to the channel 8*x*. For example, a bottom surface of the connector 9 can be provided with an upwardly rising laterally extending recess 9*y*, which can receive an upwardly protruding locking stub 24*x* disposed on a lower biasing hinge 24 of the housing 8. For example, in some embodiments, as the connector 9 is manually slidably engaged through the channel 8*x* (in the direction of arrow "A"), the connector 9 abuts against the upwardly protruding locking stub 24*x*, which can be formed with a rearward facing rising slope 9*z*, such that the connector 9 can slide over the slope 9*z* forcing the lower biasing hinge 24 (which is resilient) downward along with the locking stub 24*x*, until the locking stub 24*x* aligns with the laterally extending recess 9*y*, upon which the lower biasing hinge can bias the locking stub 24*x* upward into the laterally extending recess 9*y*, to lock, or otherwise, temporarily secure the connector 9 body within the housing 8.

Figure 6:
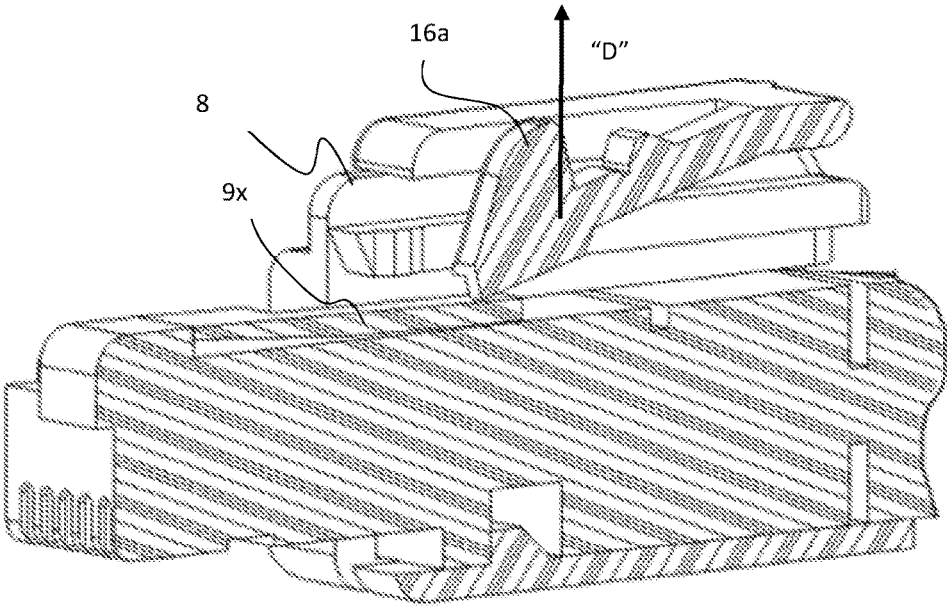
FIG. 6 is a partial cross sectional perspective view showing the housing and connector of FIG. 5, with the connector attached to the housing, and with a release button on the housing having been manually depressed against a locking tab on the connector, for some embodiments of the present disclosure.

Referring to FIGS. 5 & 6, in some embodiments, an upper biasing hinge 16*c* (which is also resilient) is formed on, or otherwise provided on, the horizontal top retaining wall, which can include release button 16*a* formed on a distal end portion thereof. As shown in FIG. 5, a user can depress the release button 16*a* (e.g., downward in the direction of arrow "C") to cause the upper biasing hinge 16*c* to descend downward and abut against a locking tab 9*x* of the connector 9 retained in the housing 8, which in turn, can cause the locking tab 9*x* to move from a raised locking position, to a lowered releasing position (e.g., See, FIG. 6), in order to release the connector 9 from a socket 70 in which the connector 9 is attached, as will be appreciated by those skilled in the art after reviewing this disclosure.

Figure 3:
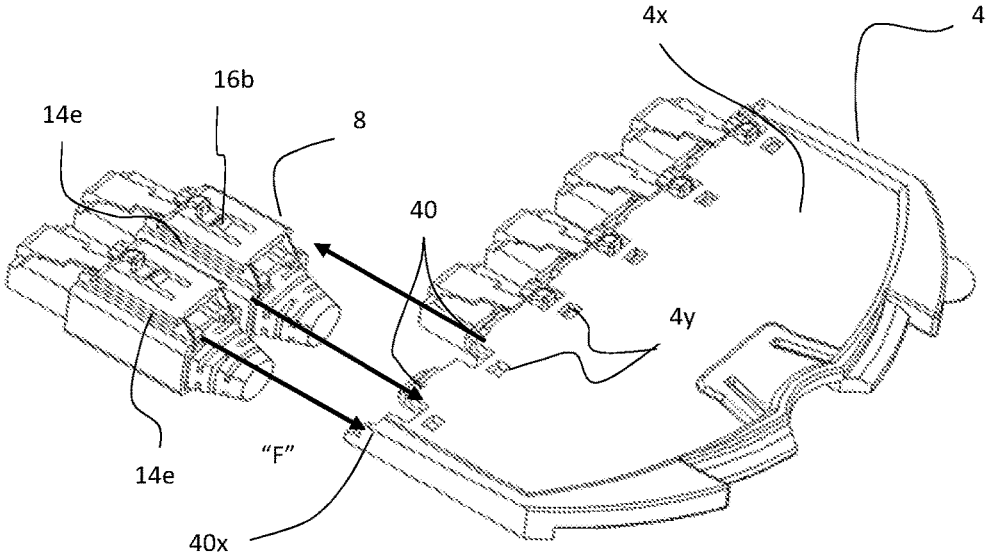
FIG. 3 is a perspective view for some embodiments of the present disclosure, showing a ganging device to which a plurality of housings for cable connectors have been attached, and also showing standalone housings yet to be coupled to the ganging device.

In some embodiments, the connector 9 and housing 8 assembly can be connected to track(s) 40 (See, e.g., FIG. 14*a*) of the ganging device 4. Referring to FIG. 3, a plurality of individual housings 8, each coupled to a connector 9, can be connected to the ganging device 4, by slidably and snugly engaging the spaced apart tracks 40 into the respective track channels 14*e* formed on sides of the connector housings 8 (as described, supra). Each side of each laterally interior track 40 can be sized to slidably and snugly engage a track channel 14*e* of an adjacent housing 8, to retain, or assist in retaining, each housing 8 between two tracks 40. Exterior tracks 40*x* slidably and snugly engage an outwardly facing track channels 14*e* of a laterally outer housings 8 on either side of the "gang" of housings 8.

Figure 8:
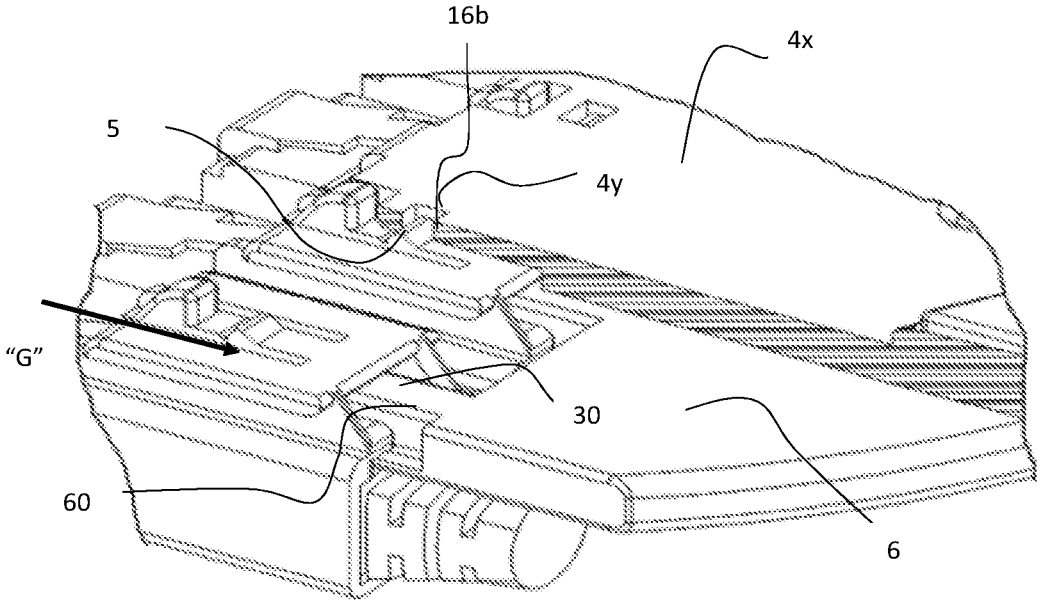
FIG. 8 is a partial cross sectional perspective view showing a portion of the plunger member and ganging device of FIG. 1 connected together, including a housing coupled to cable connectors and attached to the ganging device, with a cross sectional portion of the ganging device exposed, for some embodiments of the present disclosure.

Also, as can be seen in FIGS. 2, 5 and 8, a coupling stub 16*b*, formed on the upper biasing hinge 16*c* of each housing 8 can include a forward facing surface 16*d* having rearwardly rising slope, and a rearward facing surface 16*e*, having forwardly rising slope. As such, as a housing 8 is pushed rearward (relative to the ganging device 4), in the direction of arrow "G" (See, e.g., FIG. 8) to engage respective tracks 40 (or 40*x*), the coupling stub 16*b* can abut against a bottom surface 5 of a horizontal wall 4*x* of the ganging device 4 and slide downward against it depressing the coupling stub 16*b* below the bottom surface 5, until the coupling stub 16*b* aligns with corresponding aperture 4*y* on the horizontal wall 4*x*, at which location, the coupling stub 16*b* is biased upward into the aperture 4*y*, to releasably secure the ganging device 4 to the housing 8.

Figure 7:
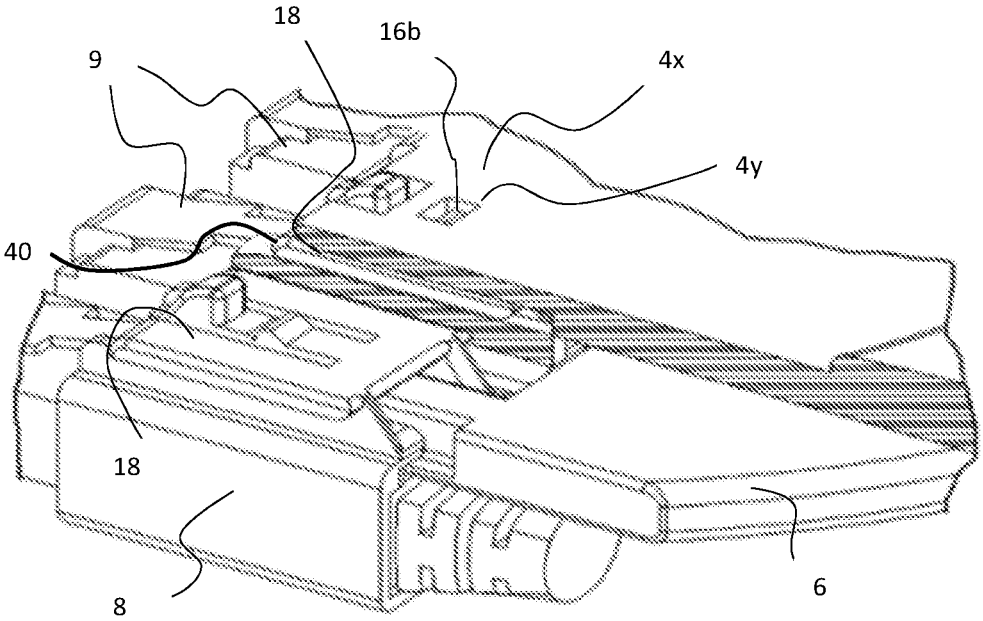
FIG. 7 is a partial cross sectional perspective view showing a portion of the plunger member and ganging device of FIG. 1 connected together, including a housing coupled to cable connectors and attached to the ganging device, with a cross sectional portion of the ganging device exposed, for some embodiments of the present disclosure.

As best seen in FIG. 7, in some embodiments of the present disclosure, the tracks 40 can be an integral part of the ganging device 4, but can extend below horizontal wall 4*x* of the ganging device 4, so as to retain the housing(s) 8 below the horizontal wall 4*x* of the ganging device 4.

As will be appreciated by those skilled in the art after reviewing this disclosure, although the example illustrations show up to six (6) connector housings 8 coupled to the ganging device 4, in other embodiments, the ganging device 4 can be configured to accommodate more than six (6) or less than six (6) connector housings 8.

Figure 17:
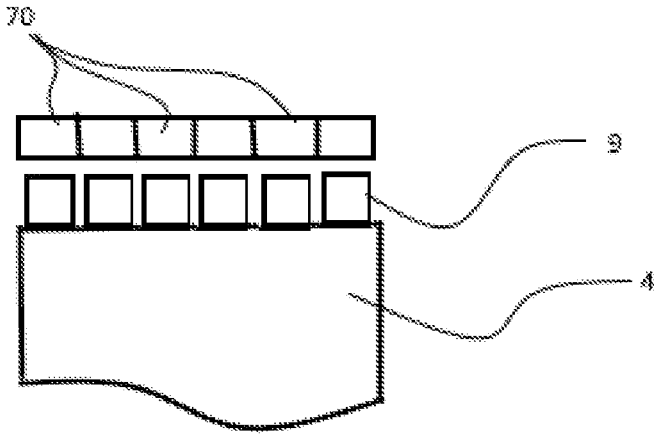
FIG. 17 is a simplified block diagram showing connection ports or sockets to which the cable connectors (attached to a ganging device of the present disclosure) can be connected or inserted.

Referring to FIGS. 9*a*-10*b*, in some embodiments, a plunger member 6 can include a body portion 6*x* and a plurality of spaced apart parallel elongated plungers 60. The plunger member 6 can be connected to the ganging device 4, with each of the plungers 60 simultaneously inserted into corresponding chambers 30 in the connector housings 8, to further secure the housings 8 to the ganging device 4, and to either cause locking tabs 9*x* on corresponding connectors 9 (coupled to the housings 8) to be retained in a raised locking position, so that the corresponding connectors 9 are locked to the connector ports (sockets) 70 to which they are attached, or to be depressed to a release position, so that the corresponding connectors 9 can be removed from a socket 70 (see, e.g., FIG. 17), as will be appreciated by those skilled in the art after reviewing this disclosure.

Figure 9A:
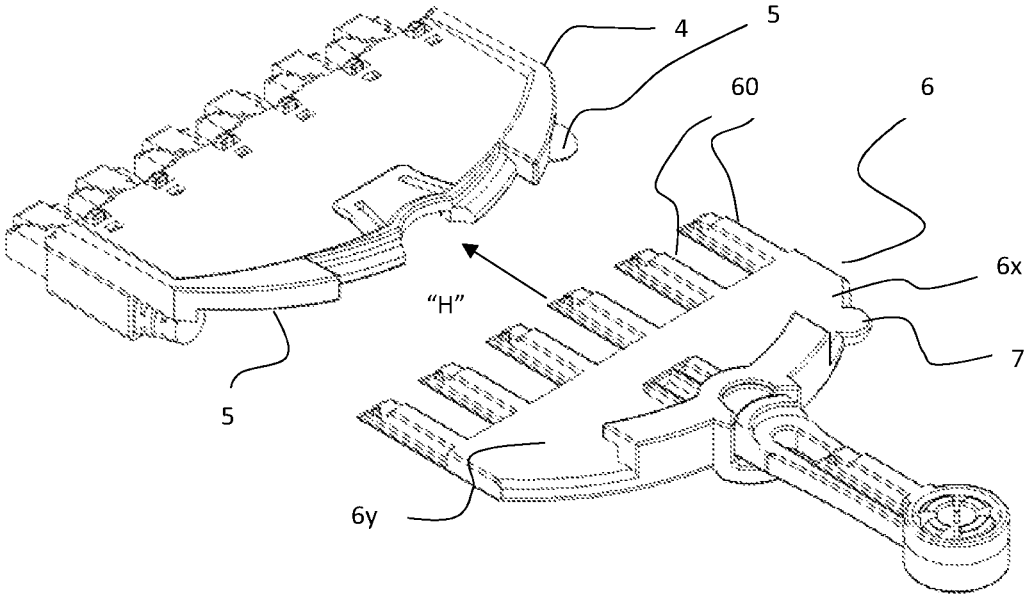
FIG. 9*a* is perspective view of the ganging device and plunger of FIG. 1, with a plurality of housings retained on the ganging device, with connectors attached to the housings, and with the plunger member in a first orientation positioned for connection to the ganging device, for some embodiments of the present disclosure.
Figure 9B:
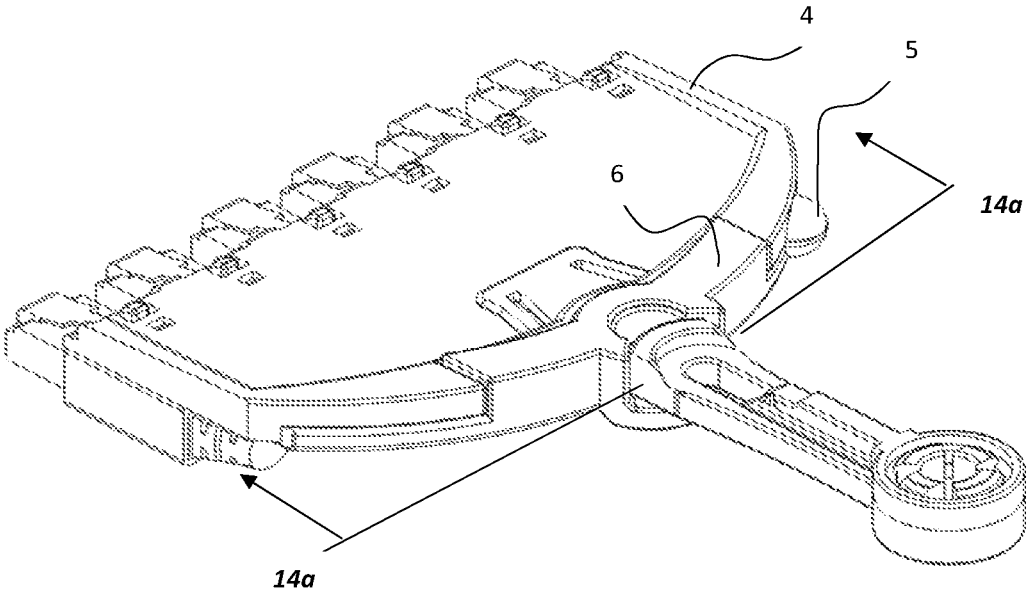
FIG. 9*b* is perspective view of the ganging device and plunger of FIG. 9*a*, connected together.
Figure 10A:
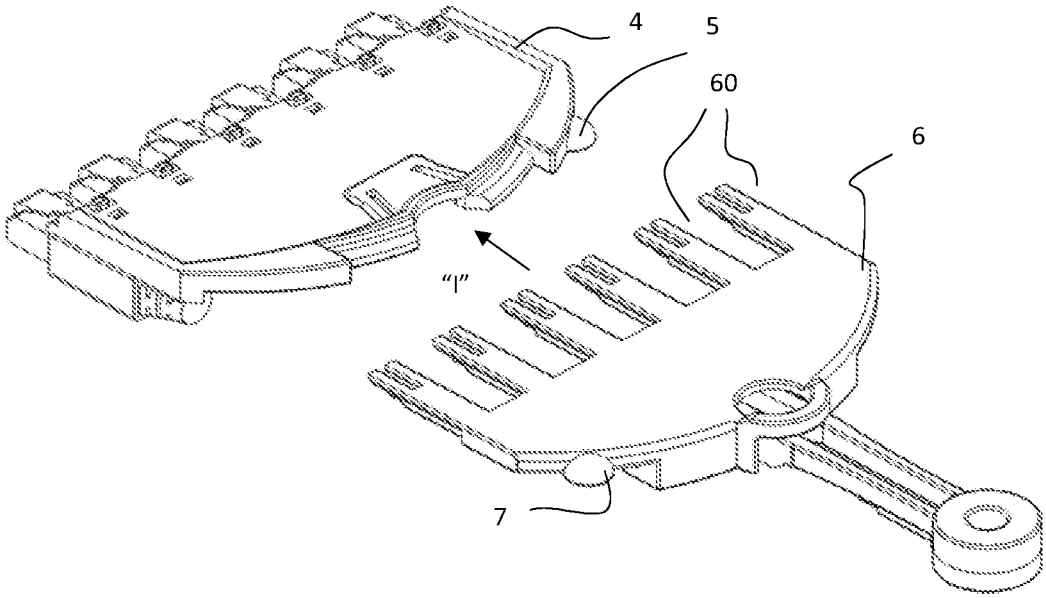
FIG. 10*a* is perspective view of the ganging device and plunger of FIG. 1, with a plurality of housings retained on the ganging device, with connectors attached to the housings, and with the plunger member in a second orientation positioned for connection to, or insertion into, the ganging device, for some embodiments of the present disclosure.
Figure 10B:
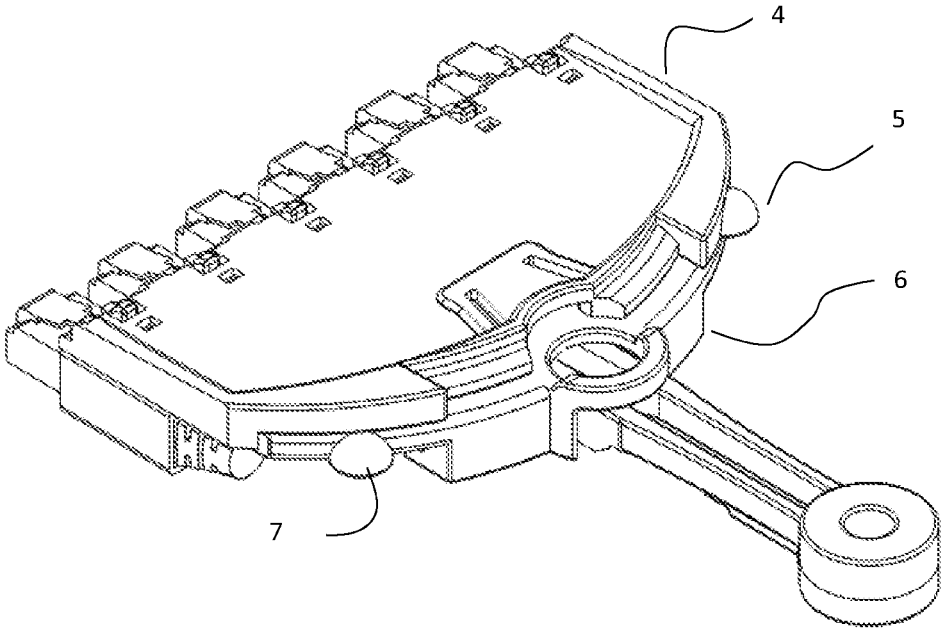
FIG. 10*b* is perspective view of the ganging device and plunger of FIG. 10*a*, connected together.

FIGS. 9*a* & 9*b* show a first orientation of the plunger member 6 from some embodiments, in which plungers 60 are oriented (relative to the ganging device 4) to cause locking tabs 9*x* on the connectors 9 to be retained in a raised locking position. That is, the plunger member 6 can be brought together and mated with the ganging device 4, in the direction generally represented by arrow "H," wherein a top surface 6*y* of the body portion of the plunger member 6 slidably engages a bottom surface 5 of the ganging device 4, while the plungers 60 are simultaneously inserted into chambers 30 in the housings 8, between the connectors 9 and horizontal top retaining wall (See, e.g., FIGS. 5 & 11, showing the chamber 30, and a plunger 60 engaging the chamber 30 in the first orientation, respectively).

Figure 11:
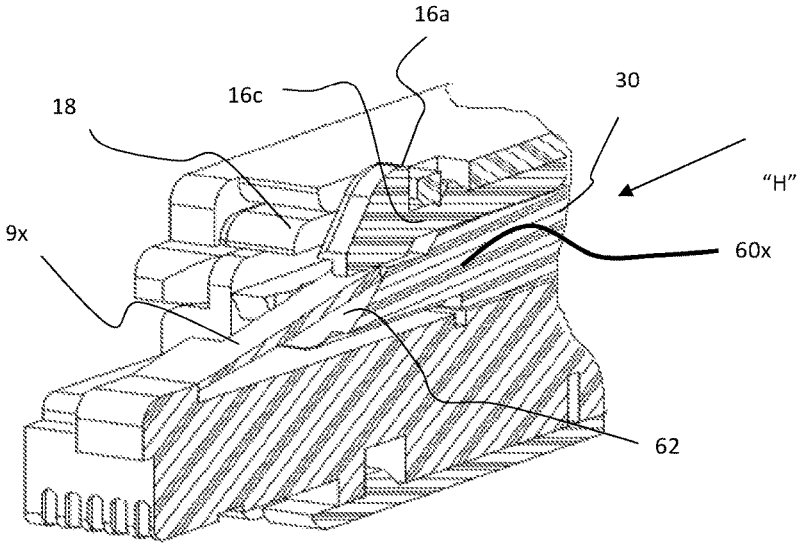
FIG. 11 is a partial cross sectional perspective view showing a housing, with a connector attached there, and with a plunger disposed in a chamber of the housing in an orientation associated with the first orientation of the plunger member, for some embodiments of the present disclosure.
Figure 14A:
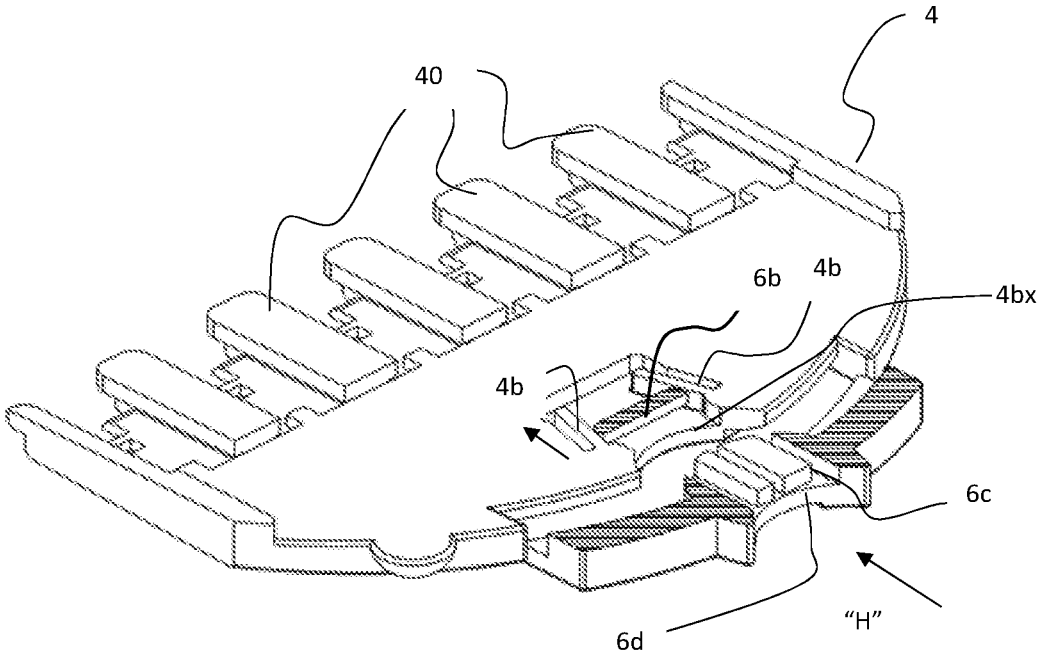
FIG. 14*a* is a partial cross sectional view of the plunger member along line 14*a*-14*a* of FIG. 9*b*, shown in process of being attached to the ganging member of FIG. 1 and FIG. 9*a*, for some embodiments of the present disclosure.
Figure 14B:
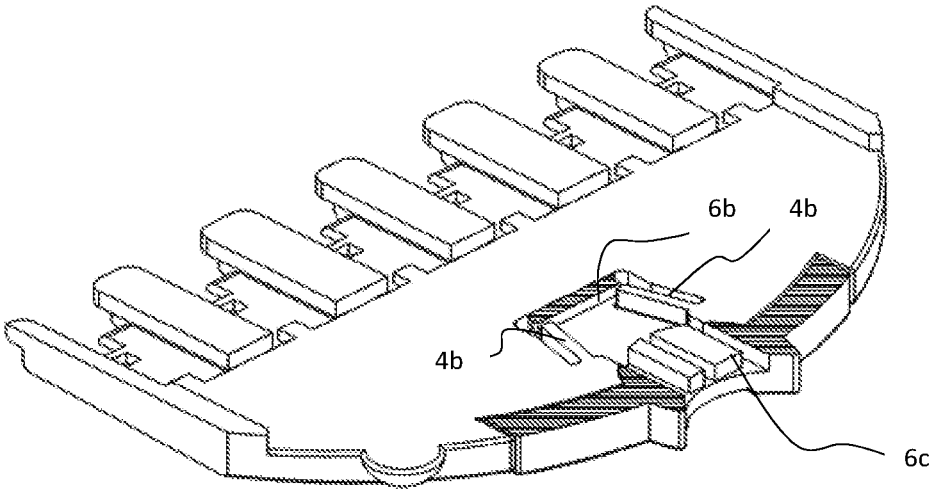
FIG. 14*b* is a partial cross sectional view of the plunger member of FIG. 14*a* attached to the ganging member of FIG. 14*a*.
Figure 15A:
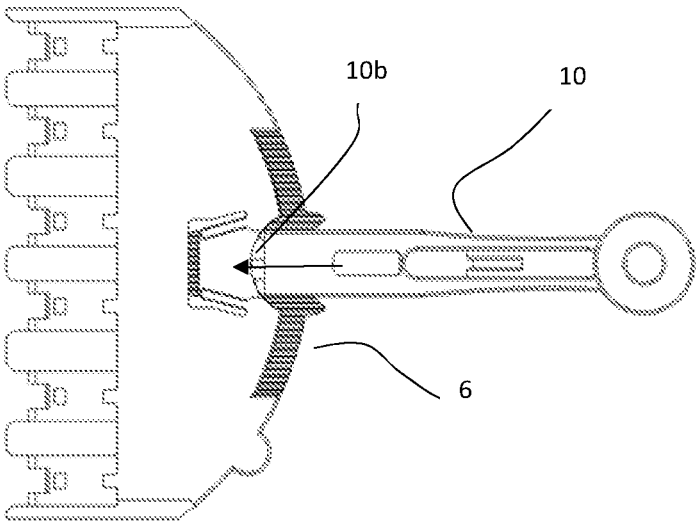
FIGS. 15*a*-15*b* are bottom cross sectional plan views showing the plunger and ganging member of FIG. 14*a*, locked together, and further showing a key being inserted through gates on the plunger and ganging device to spread resilient converging walls of the gate on the ganging member, so that the plunger member can be removed from the ganging member, for some embodiments of the present disclosure.
Figure 15B:
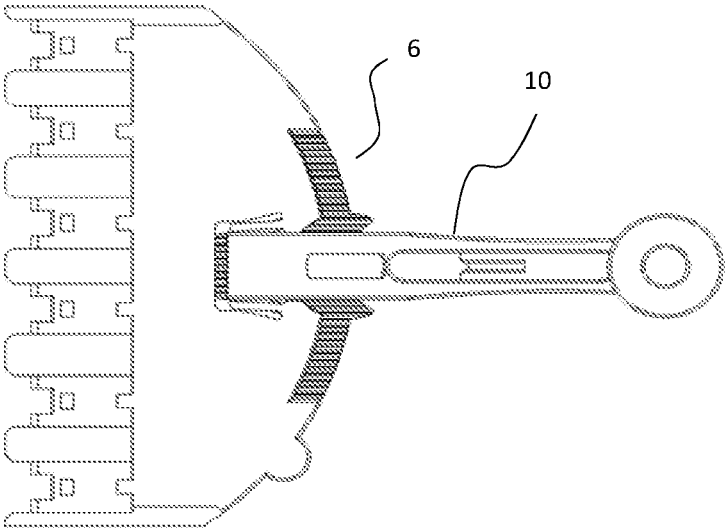
Figure 15C:
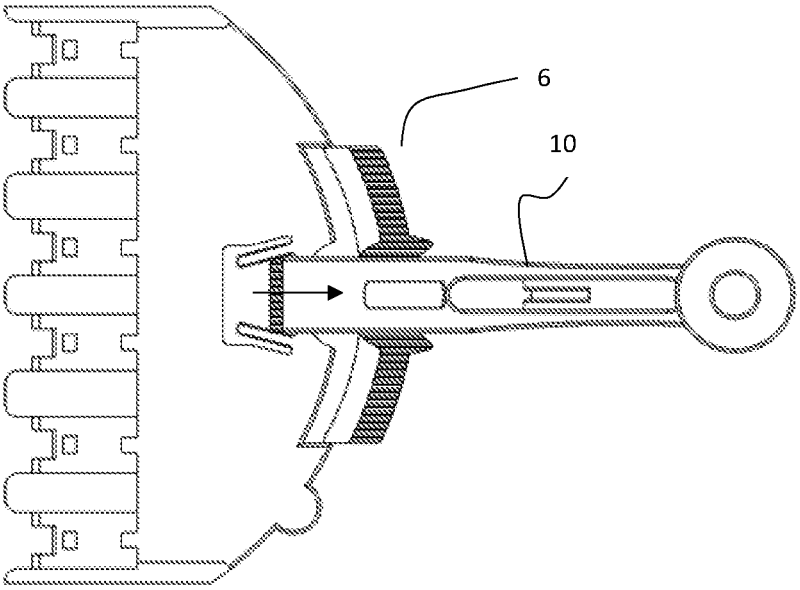
FIG. 15*c* is a bottom cross sectional plan view showing the plunger of FIG. 15*a* being removed from the ganging member of FIG. 15*a*, after a key has been inserted through gates on the plunger and ganging device to spread resilient converging walls of the gate, for some embodiments of the present disclosure.

Referring now to FIG. 11, showing a plunger 60 in first orientation having entered chamber 30, a forward facing portion 62 of the plunger 60 has upwardly rearwardly sloped surface. As the plunger 60 is pushed forward in the direction of arrow "I," a lower portion of the forward facing portion 62 tucks beneath the locking tab 9*x* and a upper portion of the forward facing portion 62 abuts a lower end corner of the locking tab 9*x*, to prevent it from being depressed downwardly, thereby securing the locking tab 9*x* in a locked position. That is, for example, referring to FIGS. 1, and 14*a*, 14*b*, in some embodiments, the plunger member 6 has stop member 6*b*, protruding upward above a top surface 6*y* thereof, so as to engage a gate 4*bx* on a bottom surface of the ganging device 4, including of a pair of resilient converging walls 4*b*. Referring to FIGS. 14*a* & 14*b*, in some embodiments, the stop member 6*b* is configured such that, when the plunger member 6 is engaged with the ganging device 4, the stop member 6*b* aligns with the gate 4*bx*, and can be pushed through the gate 4*bx* in the general direction of arrow "H," to pass through an entrance gap between the resilient converging sidewalls 4*b* at location where they begin to converge. As the plunger member 6 continues to be pushed forward, each lateral side portion of the stop member 6*b* eventually simultaneously contact one of the pair of resilient converging walls 4*b*. The resilient converging walls 4*b* can be connected at rear portions thereof to a vertical sidewall of the ganging device 4, and as the plunger member 6 continues to be pushed forward in the direction of arrow "H," distal end portions of the resilient converging walls 4*b* are forced outward into parallel alignment to allow the stop member 6*b* to continue to slide forward between the resilient converging walls 4*b*. Once the stop member 6*b* is pushed forward past a front end portion of the resilient converging walls 4*b*, the walls are immediately biased inward to resume their converging configuration, such that the stop member 6*b* is restricted from being withdrawn by the end portions of the converging walls 4*b*, thereby further securing the plunger member 6 to the ganging device 4, when the plunger member 6 is in the first orientation.

In some embodiments, when the plunger member 6 is in the first orientation, and secured to the ganging device 4, it is restricted from being withdrawn due, in part, to the stop member 6*b* interaction with the gate member 4*bx*, while the plungers 60 retain the locking tabs 9*x* of the connectors 9 in raised locking position. Thus, a user can conveniently insert a gang of connectors 9 attached to the ganging device 4 into sockets simultaneously, with the plunger member 6 secured to the ganging device 4 in the first orientation, either during insertion, or after, and the connectors 9 will thereafter be locked to the sockets into which they have been inserted. Furthermore, as can be seen in FIG. 11, when the first orientation is secured, the release button 16*a* for the locking tabs 9*x* of the connectors 9 also cannot be depressed, as a bottom of the hinges 16*c* abut against the plunger 60.

Figure 12:
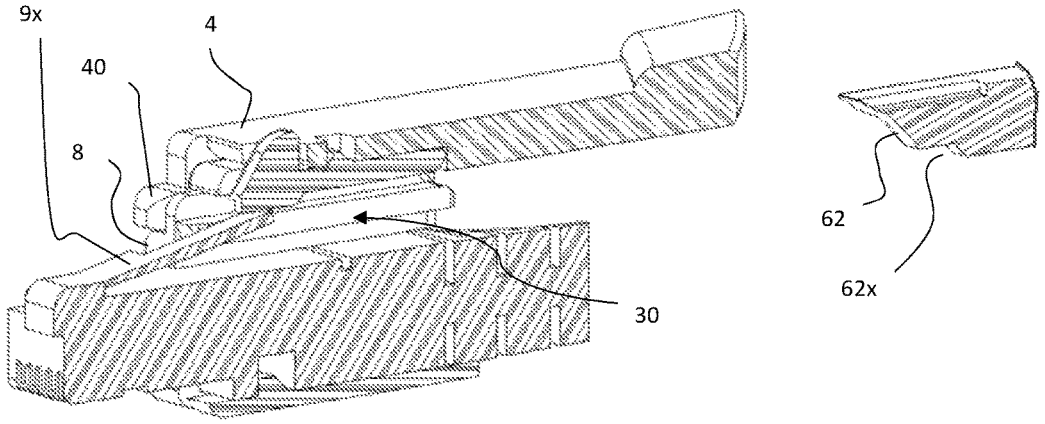
FIG. 12 is a partial cross sectional perspective view showing the housing and connector for FIG. 11, with the plunger disposed in closed proximity ready for insertion into the chamber of the housing, in an orientation associated with a second orientation of the plunger member, for some embodiments of the present disclosure.
Figure 13:
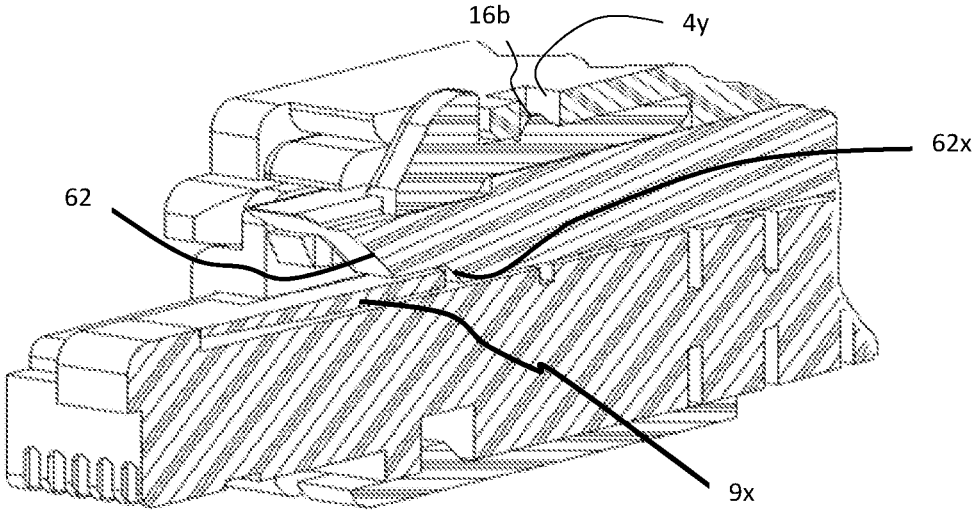
FIG. 13 is a partial cross sectional perspective view showing the housing and connector for FIG. 12, with the plunger inserted into the chamber of the housing, in an orientation associated with a second orientation of the plunger member, for some embodiments of the present disclosure.

Referring to FIGS. 1, 14*a*-15*c*, in some embodiments, a key 10 having a key bit 10*b*, can be used to unlock the plunger member 6 from the ganging device 4, to permit withdrawing of the ganging device from the connector housings 8. For example, the plunger member 6 can comprise a companion gate 6*d*, having ribs 6*c* that correspond with the key bit 10*b*, to allow passage of a key through the companion gate only if the key has a correctly corresponding key bit 10*b*. If the key bit 10*b* corresponds, then a front of the key 10 can pass through the companion gate 6*d*, and then through the gate 4*bx* on the ganging device 4, between rear portions of the resilient converging walls 4*b*, to abut against the walls 4*b* to force distal end portions of the walls 4*b* apart as the key is pushed forward. In turn, the stop member 6*b* can pass between the walls to be withdrawn, so that the plunger member 6 can be withdrawn from the ganging device 4. Referring to FIGS. 10*a*, 10*b*, 12 and 13, in some embodiments, the plunger member can be used in a second orientation, by first flipping the plunger member 6 about a longitudinal axis, 180 degrees, so that a bottom portion of the plunger member 6 (relative to the first orientation) is facing upward. This reverses the slope of the front facing portion 62 of the plungers 60 relative to the ganging device 4 and locking tabs 9*x* on the connectors 9. As can be seen in FIGS. 12 & 13, in this second orientation, as the front facing portion 62 of each plunger 60 approaches the locking tab 9*x*, an end portion of the locking tab 9*x* abuts a rearwardly downwardly sloped surface of the front facing portion 62, such that, as the front facing portion 62 is pushed forward, the end of the resilient locking tab 9*x* is forced to slide downward along the sloped surface 62, until it comes to rest at a release (unlocked) position, and can pass under a notch 62*x* formed at a bottom portion of the front facing portion 62 of the plunger 60, to retain the locking tab 9*x* below the plunger 60. In this configuration, a user can have unlocked all connectors 9 on the ganging device 4 simultaneously, so that the user can then pull the ganging device 4 outward away from a switch panel to remove the connectors 9. It is also noted that, in some embodiments, in both the first orientation and second orientation, when the plungers 60 are inserted in the housings 8, it can prevent the hinge 16*c* of the housing 8 from being depressed, so that the coupling stub 16*b* stays within the aperture 4*y* to help prevent separate of the housings 8 from the ganging device 4, as a user pulls on the ganging device 4. As such, in the second orientation, the user can pull on the ganging device 4 to easily remove all of the connectors 9 simultaneously from the switch panel.

In the example shown, there are six (6) plungers, each positionable within a corresponding chamber of housings 8. In other embodiments, more than six, or less than six plungers can be provided. For example, some other embodiments may have two plungers, or three plungers, or eight plungers, or any other number as desired by a user, and can be usable with ganging devices 4 capable of retaining up to the matching number of housings 8.

In some embodiments, the ganging device 4 can be removed from connectors 9 without removing the connectors from sockets. This allows the operator to easily gain access for removing individual connectors as necessary. Thus, some operators may utilize the connector assembly components for rapid deployment of patch cords, and then remove the tool, permanently or temporarily, while others may leave it with the connected connectors. The connector assembly 2 can be permanently removed if desired without disrupting service to ports. The tool can be constructed to support operation with IT switches or patch panels, as will be appreciated by those skilled in the art after reviewing this disclosure.

Figure 16A:
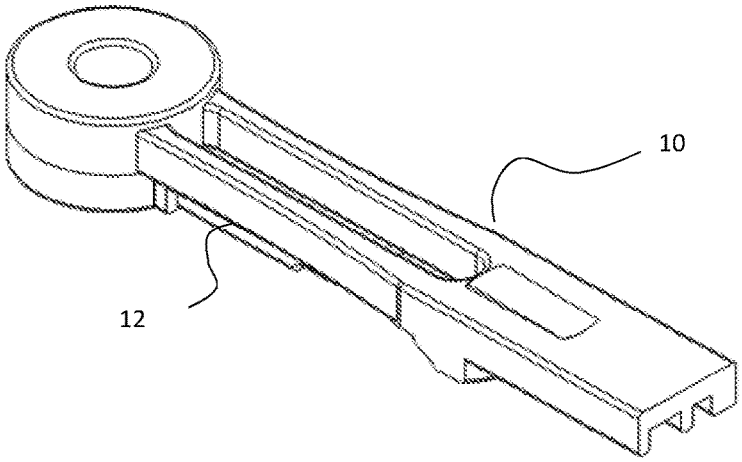
FIGS. 16*a*-16*c* show perspective views of a combination key/removal tool of the present disclosure, and further show the combination key/removal tool in a collapsed position in FIG. 16*a*, and after the removal tool has been pivoted outward in the direction of arrow "K" to an extended position ready for use in FIG. 16*b*, and in use in FIG. 16*c* inserted into a chamber of the illustrated connector housing to contact a locking tab and depress the locking tab to release the connector from a socket.
Figure 16B:
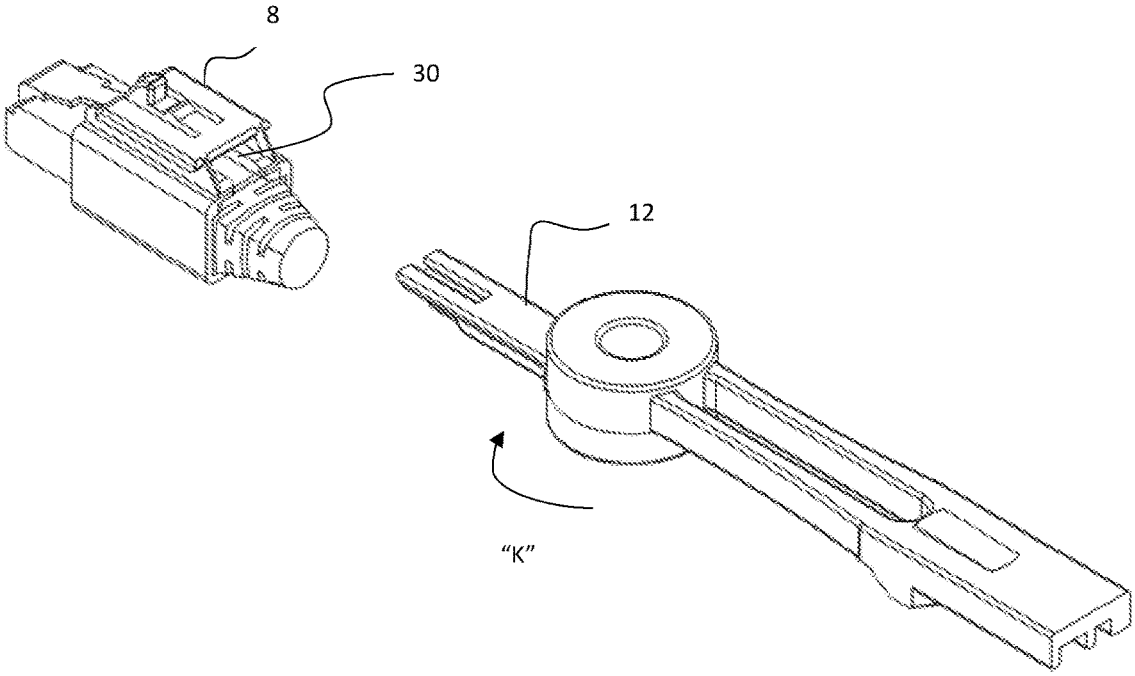
Figure 16C:
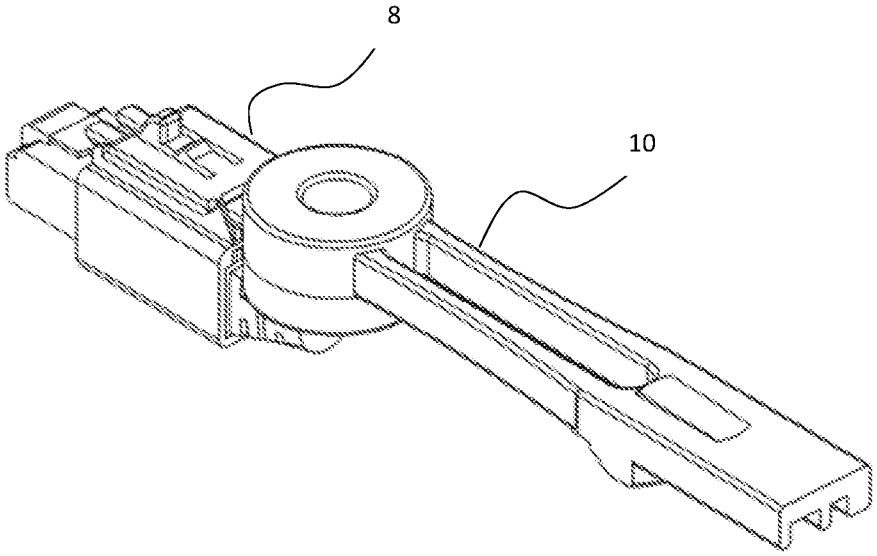

In some embodiments of the present disclosure, they key 10 can have an attached removal tool, for use in individual removing connectors. Referring to FIGS. 16*a*-16*c*, a removal tool 12 can be pivotably connected to the key 10, can be pivoted, or collapsed, under the key 10 for storage, and can be pivoted outward in the direction of arrow "K" for use. The removal tool 12 can have a similar, or same front portion configuration as the plungers 60, so that the removal tool 12 can be inserted into a chamber 30 for a housing 8, to depress a locking tab 9*x* of a connector 9 in the housing 8, so that the connector can be pulled away from a socket, or receiving port individually. In various spaces with tight access, where the release button 16*a* may be difficult to reach, the removal tool can provide added convenience.

In various embodiments of the present disclosure, the connector assembly 2 can be modified to accommodate varying widths between connection ports (sockets) 70 with different pitch sockets (e.g., RJ45 sockets), as will be appreciated by those skilled in the art after reviewing this disclosure.

In some example embodiments, a ganging device can accommodate interchangeable plunger members or a plunger can accommodate interchangeable ganging devices.

In some embodiments of the present disclosure, the plunger member 6 can be marked indicate whether the appropriate side of the plunger member 6 is facing upward for use in locking cable connectors versus extracting connectors. For example, as shown in FIGS. 9*a* and 9*b*, tab 5 and tab 7 can be provided respectively on each of the ganging device 4 and plunger member 6, and can be disposed on side portions thereof, such that, they align when the plunger member 6 is in the first orientation for use in locking the locking tabs 9*x* of the connectors 9. Conversely, the tabs 5, 7 do not align when the plunger member 6 is mated with the ganging device 4 in its second orientation for use in releasing the locking tabs 9*x*. This can provide a convenient and noticeable way for a user to avoid accidentally inserting a plunger 6 into the ganging device 4 in the second orientation, and subsequently causing an accidental disconnection of hardware, among other things. Alternatively, in some embodiments, the tabs could be color marked, or otherwise marked with indicia or letters, such that, when they do not align, the indicia is exposed so that a user can spot conspicuous indicia notifying the user that the plunger is in a release position, rather than a locking position, etc.

The various embodiments described herein, are presented as non-limiting example embodiments of the present disclosure, unless otherwise expressly indicated. After reviewing the present disclosure, an individual of ordinary skill in the art will immediately appreciate that some details and features can be added, removed and/or changed without deviating from the spirit of the disclosure. Reference throughout this specification to "various embodiments," "one embodiment," "an embodiment," "additional embodiment(s)" or "some embodiments," means that a particular feature, structure or characteristic described in connection with the embodiment(s) is included in at least one or some embodiment(s), but not necessarily all embodiments, such that the references do not necessarily refer to the same embodiment (s). Furthermore, the particular features, structures, or characteristics may be combined in any suitable manner in one or more embodiments. These and other changes can be made to the embodiments in light of the above-detailed description. In general, in the following claims, the terms used should not be construed to limit the claims to the specific embodiments disclosed in the specification, but should be construed to include all possible embodiments along with the full scope of equivalents to which such claims are entitled. Accordingly, the claims are not limited by the disclosure.

What is claimed is:

1. A cable connector assembly comprising:

a ganging device having a plurality of tracks, each track being connectable to at least one housing for at least one cable connector;

wherein the at least one housing includes a release button formed on a resilient hinge, the resilient hinge disposed above a locking tab of the at least one cable connector when the at least one cable connector is coupled to the at least one housing such that the release button is depressible to urge the resilient hinge toward the locking tab; and a plunger member having a plurality of plungers, the plunger member being connectable to the ganging device with the plurality of plungers simultaneously extending into a plurality of housings connected to the ganging device, and the plunger member being connectable to the ganging device in at least a first orientation of connection and a second orientation of connection, with each of the first orientation of connection and the second orientation of connection presenting a different slope for front facing portions of the plungers that each face locking tab of corresponding cable connectors connected to the plurality of housings.

2. The cable connector assembly of claim 1 wherein the first orientation of connection is usable for locking the corresponding cable connectors to connection ports, and the second orientation of connection is usable for unlocking the corresponding cable connectors from connection ports.

3. The cable connector assembly of claim 1 wherein when the plunger member is connected to the ganging device in the second orientation of connection, the plurality of plungers abut against locking tabs of the corresponding cable connectors in the plurality of housings connected to the ganging device to depress the locking tabs toward the corresponding cable connectors.

4. The cable connector assembly of claim 1 wherein when the plunger member is connected to the ganging device in the first orientation of connection, the plurality of plungers abut against the locking tabs of the corresponding cable connectors in the plurality of housings to retain the locking tabs away from the corresponding cable connectors.

5. The cable connector assembly of claim 1 wherein when he plunger member is connected to the ganging device in the second orientation of connection, the plunger is not locked to the ganging device.

6. The cable connector assembly of claim 1 wherein when the plunger member is connected to the ganging device, at least one of the plungers abuts against a movable coupling stub in at least one housing which mates with the ganging device to lock the housing to the ganging device.

7. The cable connector assembly of claim 1 wherein when the plunger member is connected to the ganging device in the first orientation of connection, the plunger member is locked to the ganging device by a restrictive stop member.

8. The cable connector assembly of claim 7 wherein the plunger member is locked to the ganging device by the restrictive stop member being disposed forward of resilient converging sidewalls of a gate on the ganging device.

9. The cable connector assembly of claim 8 further comprising a key having sufficient width to spread the resilient converging sidewalls to provide sufficient separation between the converging sidewalls to withdraw the restrictive stop member so that the plunger member may be withdrawn from the ganging device.

10. A cable connector assembly comprising:

a cable connector ganging device;

a plurality of housings, each housing being releasable connectable to a cable connector, wherein the plurality of housings are configured to be releasably connectable to the ganging device;

a plunger member having a plurality of elongated plungers, the plunger member being releasably connectable to the ganging device for simultaneously contacting a plurality of locking tabs of a plurality of cable connectors that are connected to the ganging device via the plurality of housings, due to the elongated plungers extending forward sufficiently to abut the locking tabs when the plunger member is connected to the ganging device, and for retaining a position of the elongated plungers relative to the locking tabs due to plunger member being releasably connected to the ganging device; and wherein when the plunger member is releasably connected to the ganging device the elongated plungers block a coupling stub of each of the plurality of housings from being withdrawn from the ganging device, to releasably lock each of the plurality of housings to the ganging device.

11. The cable connector assembly of claim 10 wherein the ganging device has a horizontal top wall portion and there are tracks formed on the ganging device below the horizontal top wall portion, for use in connecting the ganging device to the plurality of housings.

12. The cable connector assembly of claim 10 wherein a front facing portion of each of the plurality of elongated plungers is vertically sloped and the plunger member can be connected to the ganging device in a first orientation, and a second orientation, wherein a slope orientation with which the front facing portions of the plurality of plungers can contact the plurality of locking tabs in the first orientation is opposite of a slope orientation with which the front facing portions of the plurality of plungers can contact the plurality of locking tabs in the second orientation.

13. The cable connector assembly of claim 10 further comprising a key connectable to at least a portion of the ganging device for displacing at least one wall on the ganging device away from a portion of a stop member disposed on the plunger member.

14. The cable connector assembly of claim 13 further comprising an elongated removal tool pivotably attached to the key, the removal tool being longitudinally insertable into at east me of the plurality of housings individually, to depress a locking tab of a cable connector coupled to the at least one of the plurality of housings.

15. A method of connecting and extracting cable connectors comprising:

attaching a plurality of housings, each coupled to a cable connector, to a ganging device;

connecting the plurality of cable connectors simultaneously to corresponding connection ports using the ganging device;

extracting the plurality of cable connectors simultaneously from the connection ports by connecting a plunger member to the ganging device in a selected orientation involving pushing at least one elongated plunger of a plurality of elongated plungers of the plunger member into each of the plurality of housings to cause the plurality of elongated plungers to contact and depress locking tabs of the cable connectors, then pulling the ganging device to simultaneously release the plurality of cable connectors from the connection ports; and disconnecting the plunger member from the ganging device, then connecting the plunger member to the ganging device in a different selected orientation while simultaneously abutting the locking tabs with the plurality of elongated plungers to block the locking tabs from being depressed to a releasing position for the cable connectors, wherein the different selected orientation is at least flipped from the selected orientation about a longitudinal axis of the plunger member by 180 degrees.

16. The method of claim 15 wherein when the plurality of elongated plungers are pushed into each of the plurality of housings, the plurality of elongated plungers each block a coupling stub of each of the plurality of housings from being withdrawn from the ganging device, to releasably lock each of the plurality of housings to the ganging device.

17. The method of claim 15 wherein connecting the plunger member to the ganging device comprises releasably locking the plunger member to the ganging device by pushing a stop member disposed on the plunger member past an angled surface on the ganging device to displace the angled surface.

18. The method of claim 17 further comprising unlocking the plunger member from the ganging device by pushing a key member past the angled surface to displace the angled surface.

19. The method of claim 18 wherein a structure corresponding to a key bit on the key is disposed on the plunger member.

* * * * *